United States Patent [19]

Jacquet et al.

[11] Patent Number: 4,815,312

[45] Date of Patent: Mar. 28, 1989

[54] DEVICE FOR ADJUSTING THE RELATIVE POSITION OF TWO PARTS OF THE SAME PIECE BY DEFORMATION, BY MEANS OF A CONICAL SCREW, OF AN INTERMEDIATE ZONE CONNECTING THESE TWO PARTS TOGETHER

[75] Inventors: Bruno Jacquet, Rueil Malmaison; Pierre Boudet; Jean-Pierre Tellier, both of Cergy, all of France

[73] Assignee: La Telemecanique Electrique, France

[21] Appl. No.: 76,503

[22] Filed: Jul. 22, 1987

[30] Foreign Application Priority Data

Jul. 22, 1986 [FR] France ..... 86 10602

[51] Int. Cl.[4] ..... H01H 75/08

[52] U.S. Cl. ..... 72/454; 335/45; 337/82; 72/379

[58] Field of Search ..... 335/45; 337/82, 360, 337/368; 411/402; 72/379, 454

[56] References Cited

U.S. PATENT DOCUMENTS

| | | | |
|---|---|---|---|
| 2,222,062 | 11/1940 | Baker et al. | 337/368 |
| 2,248,695 | 7/1941 | Bradshaw | 411/402 |
| 2,642,509 | 6/1953 | Cole et al. | 337/82 |
| 2,647,187 | 7/1953 | Cole | 337/82 |

*Primary Examiner*—Lowell A. Larson

*Attorney, Agent, or Firm*—William A. Drucker

[57] ABSTRACT

A device is provided for adjusting the relative position of two parts of the same piece by deforming an intermediate zone connecting these two parts together, by means of a conical screw, and having a tapped bore in which said screw may be screwed, and a cut out which extends from a first edge of the piece to said bore, wherein said intermediate zone further includes at least a second cut out opening into said bore, opposite said first cut out which defines with a second edge of the piece a deformable zone, forming a hinge, offset with respect to said bore.

8 Claims, 1 Drawing Sheet

FIG.1
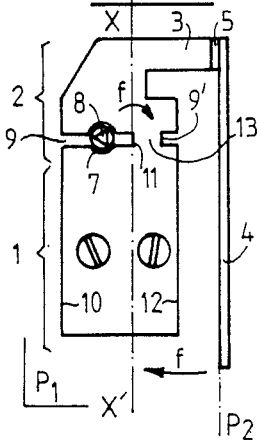
FIG. 2
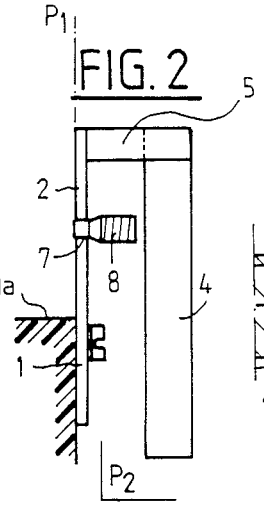
FIG.3
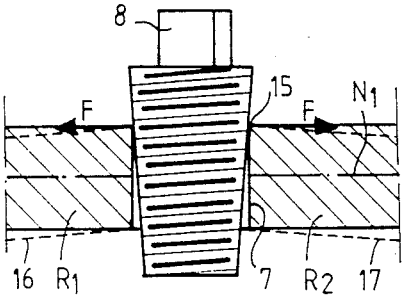
FIG.4
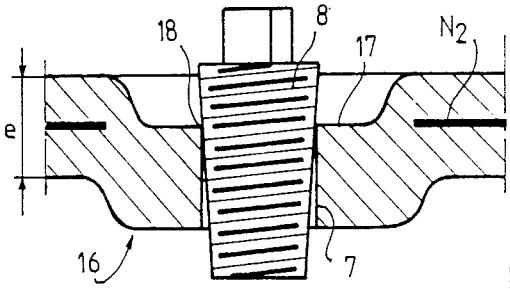
FIG.6
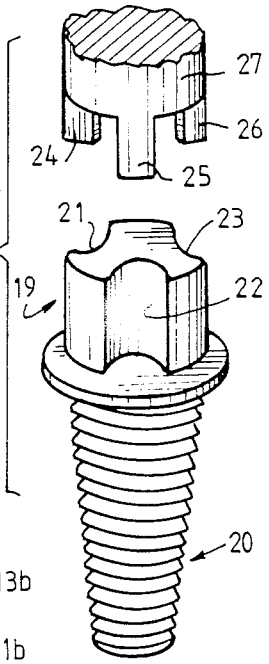
FIG. 5
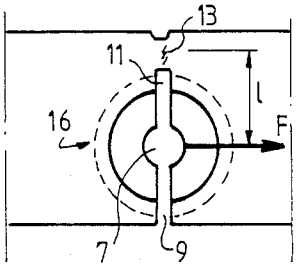
FIG.8
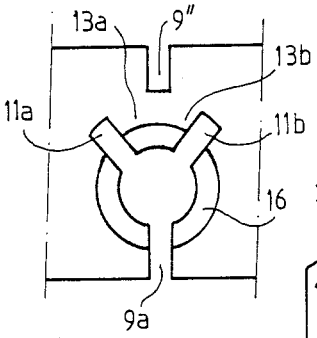
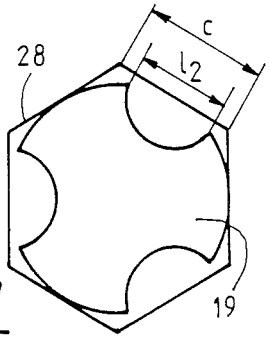
FIG.7

DEVICE FOR ADJUSTING THE RELATIVE POSITION OF TWO PARTS OF THE SAME PIECE BY DEFORMATION, BY MEANS OF A CONICAL SCREW, OF AN INTERMEDIATE ZONE CONNECTING THESE TWO PARTS TOGETHER

BACKGROUND OF THE INVENTION

1. Field of the Invention

The present invention relates to a device for adjusting the relative position of two parts of the same piece, by deforming an intermediate zone connecting these two parts together, by means of a conical screw.

It relates more particularly, but not exclusively, to such an adjustment on pieces obtained by stamping and, possibly, deformation of a sheet material such as a metal strip.

It applies more particularly to the mounting of bimetal strips used in thermal tripping apparatus such for example as thermal relays.

It is known in fact that in this type of application the tripping threshold of such apparatus depends, among other things, on the relative position of the bimetal strips and on the tripping members which are associated therewith.

Considering the manufacturing tolerances, it has proved impossible to obtain during assembly sufficient accuracy so as to obtain in the same series of apparatus strictly identical tripping thresholds. This is why it is then necessary, at the end of assembly, to adjust the position of the bimetal strips. Now, in the present state of the technique, this adjustment is a delicate operation, often carried out manually by specialized staff. It is then time wasting and does not lend itself to high rates of production of such apparatus.

2. Description of the Prior Art

To try to overcome these drawbacks, attempts have already been made to mount the bimetal strips on metal sheet pieces having a support area which may be mounted on a fixed part of the apparatus, for example the case, and a fixing area on which the bimetal strip is mounted, this fixing area extending normally to the support area, the connection of the support area to the fixing area then being formed by a deformable zone including a tapped bore and an open cut out at the level of a first edge of the piece and extending as far as said bore.

The adjustment was then provided by screwing a conical screw into the tapped bore so as to generate, by a torque effect, a torsion of the deformable zone included between the bore and a second edge of the piece opposite said first edge and so as to cause accordingly rotation of the fixing zone. In order to reduce the screwing torque required for causing said torsion, it has also been proposed to reduce the width of the deformable zone by providing a second cut out in the second edge, opposite the first edge.

However, this solution also has a number of drawbacks.

In fact, despite the presence of the second cut out, the torque required for screwing in the conical screw remains high and metal stripping has further been observed due to the fact that the force exerted by the conical screw is only applied to a very small number of threads of the bore and, because of the deformation, only to a very small part of their circumference.

Another drawback of this solution resides in the fact that, for reasons which will be discussed hereafter, the deformations to which the deformable zone is subjected subsequent to screwing, do not allow the inherent flatness of this zone to be maintained and on the contrary cause buckling thereof. Consequently, instead of having a rotational movement of the fixing zone about an axis perpendicular to the support zone, a skew movement will be obtained, incompatible with the desired adjustment function.

The purpose of the invention is then more particularly to overcome these drawbacks.

SUMMARY OF THE INVENTION

To this end it provides a device of said type adapted for adjusting the relative position of two parts of the same piece, by deformation of an intermediate zone connecting these two parts together, by means of a conical screw, this intermediate zone having a tapped bore in which said screw may be screwed and a cut out which extends from a first edge of the piece as far as said bore.

In accordance with the device of the invention, said intermediate zone further includes at least a second cut out opening into said bore opposite said first cut out and which defines with a second edge of the piece a deformable hinge region offset with respect to said bore.

With such an arrangement, the leverage with which the force resulting from the screwing in is exerted on the deformable region is considerably increased and may be adjusted so as to obtain a desired deformation with an acceptable screwing force on the conical screw.

Furthermore, deformation of the bore during screwing is more appropriate and provides a better cooperation with the threads.

Thus, for these different reasons, damage to the threads of the tapped bore and formation of shavings are reduced.

Within the scope of the above mentioned applications, said piece may be obtained from a sheet material (for example a metal strip) and include a support zone, a flat part at least of which extends in a plane, a fixing zone, a second part at least of which extends in said plane and a deformable zone which connects the support zone to the fixing zone.

In this case, so that said second flat part remains in said plane during screwing, the deformable zone includes an embossed (or stamped) region in the center of which the tapped bore is formed, the depth of this region being such that its upper part is in the plane of the neutral axis of the region of the deformable zone which surrounds said embossing.

In this case, the deformation forces generated by screwing will be exerted along this neutral axis and the deformations will take place in the plane of the deformable zone. It should be noted that the deformations undergone by the deformable zone are substantially residual. This however is not a drawback because, in most applications, the adjustment may be made in the factory and does not have to be modified subsequently. It is even often necessary to then prevent any possibility of access to this adjustment.

To overcome this problem, the invention proposes using a conical screw whose head is shaped so as to be able to cooperate with a specific tool forming for example part of an automatic adjustment device but which cannot fit standard commercially available tools and, in particular, conventional spanners and screwdrivers.

More precisely, this head has a cylindrical shape which extends coaxially to the screw and whose cylindrical surface has three grooves spaced at 120° from each other, and whose openings have a width less than the length of a side of the hexagon in which the cylindrical shape is inscribed.

BRIEF DESCRIPTION OF THE DRAWINGS

Some embodiments of the invention will be described below, by way of non limitative examples, with reference to the accompanying drawings in which:

FIGS. 1 and 2 show a front view (FIG. 1) and a side view (FIG. 2) of an adjustment device in accordance with the invention;

FIG. 3 is an enlarged schematical view of the deformable zone of the device shown in FIGS. 1 and 2, in the case where no arrangement has been made for avoiding transverse deformations;

FIG. 4 is a schematical section of this same deformable zone shaped so as to avoid said transverse deformations;

FIG. 5 is a front view of the deformable zone shown in FIG. 4;

FIGS. 6 and 7 show schematically, in perspective and in a top view, a conical tamperproof screw usable in the device of the invention; and FIG. 8 illustrates a variant.

DESCRIPTION OF THE PREFERRED EMBODIMENTS

The adjustment device shown in FIGS. 1 and 2 is more particularly intended for adjusting the alignment of the bimetal strips of a thermal relay or the contacts of a relay or a contactor. It includes a piece formed by stamping and deformation (bending) of a metal strip, this piece including more precisely:

a support zone 1 of rectangular shape which extends in the first plane $P_1$, this zone 1 being possibly equipped with means, not shown, for fixing to a fixed part, for example the case 1*a* of an apparatus such as a thermal relay;

a deformable zone 2 which extends the support zone in said plane $P_1$, this zone whose characteristics will be defined hereafter having, at its end situated opposite the support zone, a transverse strip 3 which extends while projecting with respect to said zone 1; and a fixing one 5, on which may be fixed a bimetal strip 4 or a contact which extends in a second plane $P_2$ perpendicular to the first $P_1$.

The deformable zone 2 has in its part adjacent the support zone 1 a tapped bore 7 in which may be screwed a conical screw 8, a first transverse slit 9 opening into bore 7 and opening outwardly in the side edge 10, a second transverse slit 11, diametrically opposite slit 9, which opens into bore 7 and which occupies a fraction of the distance between bore 7 and the side edge 12, and possibly a third slit 9' formed in the side edge 12, substantially in line with slits 9 and 11. Slits 9 and 11 define in region 2 a deformable zone 13 of reduced width, this zone 13 forming a hinge with axis perpendicular to the plane $P_1$ of the support zone 1.

In the initial position, the conical screw 8 may be mounted manually and scarcely projet from bore 7, so as to begin meshing of the threads of screw 8 with the threads of bore 7 close to the face situated on the engagement side. Adjustment is then obtained by screwing this screw 8 in which, by wedge effect, causes deformation of zone 13 resulting in opening of slits 9 and 11 and a rotation in the direction of arrow f of the fixing zone 5 as well moreover as the zone of the deformable region 2 which is adjacent thereto.

It can be seen more particularly that, because of the above described structure, this movement of the fixing zone 5 takes place perpendicularly to the axis of screw 8. Furthermore, the maintenance of the adjustment during time is guaranteed because screw 8 is self locking and because the residual deformation obtained does not prevent a residual resilient force being exerted cooperating in the development of a clamping torque.

It has however proved that a device of the above described type suffers from a drawback which is illustrated in FIG. 3.

In fact screw 8 is conical and since hole 7 is cylindrical, said screw 8 will only be in contact with the deformable zone by the edge 15 of bore 7 situated on the engagement side. Thus, when screw 8 is tightened, it exerts on the piece forces F applied to the edge 15 of hole 7 which generate a deformation moment with respect to the neutral axis $N_1$, which contributes to causing a relative movement of regions $R_1$ and $R_2$ of the deformation zone 2, not in plane $P_1$ but towards positions 16, 17 shown with broken lines.

It is clear that, in order to avoid these deformations, it would be advisable to cause forces F to be exerted along the axis of the neutral axis $N_1$.

The solution illustrated in FIG. 4 allows this result to be obtained.

It consists in forming at the level of bore 7 an embossed or pressed region 16 adapted so that its inner face 17 is in the extension of the neutral axis $N_2$, so that the deformation forces will be exerted along the neutral axis $N_2$ and so that the deformations of zone 2 will take place in its plane. It follows that, in order to obtain such a result, the embossed regions 16 must theoretically have a depth equal to the half depth e of the metal.

In actual fact, screw 8 drives back a little metal and the part actually meshed is not limited to the theoretical edge 18, but with experience, the depth of the embossed region 16 may be adjusted so that the plane of the neutral axis $N_2$ passes through the median part of the true bearing surface. Furthermore, the embossed region 16 must not hinder deformation of the deformable zone. For this, slit 11 must extend beyond this region, as can be seen in FIG. 5.

Of course, the dimension of the pieces, the deformable zone, the force F delivered by the conical screw 8, the slope of this latter and the lever arm 1 are adapted so as to have the desired deformation with an acceptable driving force on screw 8;

Of course, the invention is not limited to the above described embodiment. Thus for example, it would be possible to have, instead of slit 11, several other suitably arranged slits.

With reference to FIGS. 6 and 7, the tamperproof conical screw usable in the above described devices includes a substantially cylindrical head 19 coaxial with its threaded part 20. The cylindrical surface of this head 19 includes three axial grooves 21, 22, 23, spaced apart from each other by 120°, provided for receiving three corresponding drive dogs 24, 25, 26 of a screwing tool only the head 27 of which has been shown.

So that they may not serve for engaging a conventional screwing tool such as a flat or eyewrench, these grooves 21, 22 and 23 have, at the level of the cylindrical surface, a width $l_2$ less than that of a side c of the hexagon 28 in which the cylindrical head 19 is inscribed.

It is clear that with such an arrangement screwing in or screwing out of the screw will be made impossible without a tool specially designed for this purpose.

As can be seen in FIG. 8, the device of the invention is not limited by the presence of two aligned slits joining up with the cylindrical opening 7*a* receiving the adjustment screw; in this Figure, two auxiliary slits 11*a*, 11*b* are placed substantially so as to converge towards an emerging slit 9*a* which is itself possibly in the extension of an opposite slit 9″. In this variant, there exist two deformable regions 13*a* and 13*b*.

What is claimed is

1. In a device for adjusting the relative position of first and second parts of the same piece, by deformation of an intermediate zone connecting said first and second parts together, said first part having first and second opposite edges and said intermediate zone having a tapped bore in which a screw may be screwed for subjecting the intermediate zone to a torsion, a cut out extending from the first edge to said bore, said intermediate zone further includes at least one further cut out opening into said bore, opposite the first cut out and which defines with the second edge a deformable region, forming a hinge offset with respect to said bore in the direction of the second edge.

2. The device as claimed in claim 1, wherein said piece is made by stamping and possibly bending a sheet metal material.

3. The device as claimed in claim 1, wherein said first part forms a support zone comprising a flat portion which extends in a first plane, said second part forms a fixing zone and said intermediate zone includes a flat portion which extends in said plane and in which said bore is formed.

4. The device as claimed in claim 3, wherein said intermediate zone includes an embossed region in the center of which the tapped bore is formed, the depth of the region embossed being such that the inner surface of the embossed region which contains the bore edge which is engaged by the conical screw is substantially in the plane of the neutral axis of the region of the intermediate zone surrounding the embossed region.

5. The device as claimed in claim 4, wherein said neutral axis passes through the median part of the true bearing surface of the screw with said bore.

6. The device as claimed in claim 1, wherein said second slit projects from the embossed region.

7. The device as claimed in claim 1, wherein said first part includes a flat support zone of rectangular shape which extends in a first plane; said intermediate zone extends said support zone in said plane and has, in a first portion thereof adjacent the support zone, a tapped bore in which a conical screw may be screwed, a first transverse slit opening into said bore and opening outwardly at the level of a first side edge of the piece, at least a second slit situated opposite the first slit and which opens into the bore and extends over a fraction of the distance which separates said bore from a second edge of the piece, said intermediate zone further having, at its end situated opposite the support zone, a transverse strip which projects with respect to said intermediate zone; and said second part includes a fixing zone which extends in a second plane perpendicular to said first plane.

8. The device as claimed in claim 1, wherein said conical screw includes a threaded part and a substantially cylindrical head coaxial with said threaded part, the cylindrical surface of this head having three axial grooves spaced apart, from each other by 120° and having a width less than that of a side of the hexagon in which said cylindrical surface is inscribed.

* * * * *